United States Patent [19]

Wall et al.

[11] Patent Number: 4,767,063

[45] **Date of Patent: * Aug. 30, 1988**

[54] ADAPTABLE MATERIAL SPREADING VEHICLE

[75] Inventors: Albert J. Wall, Woburn, Mass.; James T. Wall, 137 Russell St., Woburn, Mass. 01801

[73] Assignee: James T. Wall, Woburn, Mass.

[ * ] Notice: The portion of the term of this patent subsequent to Jun. 11, 2002 has been disclaimed.

[21] Appl. No.: 70,604

[22] Filed: Jul. 6, 1987

Related U.S. Application Data

[63] Continuation of Ser. No. 742,613, Jun. 7, 1985, abandoned.

[51] Int. Cl.[4] ..... E01C 19/20

[52] U.S. Cl. ..... 239/672; 222/622; 222/626

[58] Field of Search ..... 239/650, 672–680; 198/860.2, 860.4; 222/610, 622, 626; 414/529

[56] References Cited

U.S. PATENT DOCUMENTS

| | | | |
|---|---|---|---|
| 1,656,631 | 1/1928 | Hammaker | 239/674 X |
| 1,764,019 | 6/1930 | Hardenbergh | 239/670 |
| 1,824,419 | 9/1931 | Abbe | 239/672 |
| 1,924,825 | 8/1933 | Young | 239/692 |
| 2,055,139 | 12/1933 | Andrews | 198/860.4 X |
| 2,060,652 | 10/1936 | Arndd | 239/673 X |
| 2,295,472 | 9/1942 | Hopkins | 239/674 X |
| 2,307,798 | 1/1943 | Kook et al. | 222/610 X |
| 2,577,310 | 12/1951 | Connelly | 239/674 X |
| 2,697,609 | 12/1954 | Chase et al. | 239/674 X |
| 2,705,149 | 3/1955 | Torrey | 239/665 |
| 2,799,510 | 7/1957 | Schmidt | 239/672 X |
| 2,907,482 | 10/1959 | Smith | 414/507 |
| 3,065,556 | 11/1962 | Kampert | 239/661 X |
| 3,489,300 | 1/1970 | McCartney | 414/353 X |
| 3,588,155 | 6/1971 | Hirt | 222/610 X |
| 3,610,474 | 10/1971 | Usher | 222/626 |
| 4,522,341 | 6/1985 | Wall et al. | 239/672 |

FOREIGN PATENT DOCUMENTS

| | | | |
|---|---|---|---|
| 142987 | 2/1950 | Australia | 198/860.2 |
| 993310 | 10/1951 | France | 239/672 |

*Primary Examiner*—Andres Kashnikow
*Assistant Examiner*—Kevin P. Weldon
*Attorney, Agent, or Firm*—Weingarten, Schurgin, Gagnebin & Hayes

[57] ABSTRACT

An adaptable material-spreading vehicle includes in combination a truck body frame, an engine mounted on the frame, a cab mounted in a forwardly positioned cab region, a removable hopper positioned behind the cab region, and a conveyor running from beneath the hopper directly through the cab region to a forwardly mounted material spreader with the hopper and conveyor being removably mounted to the truck frame, such that the material spreader vehicle can be converted to some other use. In one embodiment, the cab is provided with a central channel through the floor to accommodate the section of the conveyor passing through the cab region, with the cab being provided with sealable conveyor ports aligned fore and aft through which the cab-carrier conveyor section is passed. In a preferred embodiment, the conveyor runs the entire length of the bottom of the hopper through such that material is initially removed from the rear of the hopper, thereby providing that the majority of the weight of the dispensed material is as far forward as possible.

18 Claims, 7 Drawing Sheets

ADAPTABLE MATERIAL SPREADING VEHICLE

CROSS-REFERENCE TO RELATED APPLICATION

This application is a continuation of application Ser. No. 742,613, filed June 7, 1985, now abandoned.

FIELD OF THE INVENTION

This invention relates to material-dispensing vehicles, and more particularly to apparatus for the dispensing of sand, salt, and like material in front of the dispensing vehicle.

BACKGROUND OF THE INVENTION

In the past there have been many vehicles adapted for the sanding and salting of roads during the winter months involving the utilization of spreading devices mounted to the vehicle, such as illustrated by U.S. Pat. Nos. 1,764,019; 1,824,419; 1,656,631; 1,924,825; 2,060,652; 2,295,472; 2,577,310; 2,697,609; 2,705,149; and 2,907,482. In more recent times, conventional dump trucks have been modified by strapping a hopper on the back of the dump truck, with a conveyor running from the bottom of the hopper out the back of the dump truck to a spreader suspended at the end of the conveyor.

While the above modification to existing dump trucks facilitates the conversion of the dump truck for sanding purposes in the wintertime, it will be appreciated that the visibility of the rear-mounted spreading apparatus is limited with the respect to the driver of the vehicle. Moreover, sand is distributed after the truck so that the truck traction derives no benefit from the sanding procedure. This problem is particularly acute when depositing sand over freshly oiled and treated roadways. Dump trucks so adapted have been known to slip off the road due to the oily surface and consequent lack of traction.

With respect to those of the above-noted material spreaders mounted at the front of the vehicle, it will be appreciated that each of these vehicles is solely adapted to the spreading of material and cannot easily be modified to provide for another use for the vehicle, either during non-winter months or otherwise. In general, these vehicles are provided with fixed hoppers and fixed conveying means which run around or under the vehicle cab.

In addition to the fixed attachment of the conveying means and the hopper to the vehicle body, there is no ability for the driver to inspect the material carried by the conveying systems during spreading.

The lack of adaptability of the vehicles noted in the above-mentioned patents is particularly severe from a cost-of-operation point of view, since sanding and salting operations occur but a fraction of the useful lifetime of the vehicle. It is therefore a necessity to provide an easily adaptable vehicle in which front spreading is employed, in which appropriate traction can be obtained during the sanding and salting procedure, and in which the procedure can be readily viewed and controlled by the operator of the vehicle.

SUMMARY OF THE INVENTION

A vehicle adapted for forward material dispensing and other uses includes in combination a vehicle having an engine, rear-mounted in one embodiment, and a cab mounted in a forwardly positioned cab region. Behind the cab is located a removably mounted hopper, which in a preferred embodiment has an elongated trough which opens to a portion of a conveyor positioned immediately therebeneath. The conveyor is segmented in that a portion is associated with the hopper, whereas a second portion passes through the cab region. The hopper is mounted on the vehicle frame with the exit port of the hopper facing the back of the cab region. In one embodiment, the cab itself is provided with access ports or cutouts at the back and front, and its floor is channeled therebetween to permit the insertion of the second portion of the conveyor through the cab body. This portion of the conveyor is exposed within the cab in a preferred embodiment to permit inspection of the dispensed material prior to its being dispensed by a dispensing mechanism located forward of the cab at the end of the conveyor which projects from the front of the cab.

When in use as a material spreader, the hopper with its portion of the conveyor is lowered into place on the truck frame behind the cab, and the second portion of the conveyor passes through the cab region, where it is joined to a mating portion of the conveyor which protrudes from the forward bottom portion of the hopper. The conveyor portions are linked up, and the material spreader is then positioned at the free end of the conveyor which projects in front of the cab. In a preferred embodiment, the longitudinally running truck frame channels extend beyond the position at which the spreader is mounted such that a bumper or other device can be located on the frame ahead of the spreader. Such other device may include a conventional snow plow.

The conveyor portion when running through the cab, can be exposed so that the dispensed material can be observed by the driver of the vehicle. The conveyor can also be covered either with a transparent housing or with an opaque housing provided with a trap door for visual inspection of the dispensed material.

The conveyors used herein are conventional and are usually provided integrally at the bottom of conventional hoppers. Such conveyor-hopper systems are manufactured by Fox Brady as Model No. 0560 or by Gledhill Road Machinery Co. as Model No. LV-24 - Conventional Spreader. In general the conveyors are operated hydraulically in which hydraulic fluid is pumped from the vehicle engine to power both the conveyor motor and the spreader. In order to provide for the quick adaptability of the vehicle, quick disconnects are provided for the hydraulic lines to the spreader and to the conveyor motor so that the vehicle can be quickly and readily adapted to other uses.

With a rear-mounted engine, additional traction is given to the drive wheels. Additionally, when the hopper is provided with a conveyor which runs the entire length of the bottom of the hopper, the material is moved from the rear of the hopper first, leaving the majority of the material towards the front of the hopper. This provides sufficient weight and traction for the front wheels of the vehicle.

The subject vehicle spreading system alleviates a common problem associated with rear spreading dump trucks which must be backed up slippery hills in order to negotiate the hills. Rather, sand and appropriate other materials are spread ahead of the subject vehicle to provide for the requisite traction.

In summary, it is the ready adaptability of the combined truck frame and front-mounted cab to both a spreading operation and other operations which permits the economic utilization of this vehicle. The center-carried hopper with a portion of its conveyor integrally carried at the bottom thereof is easily lowered onto the truck frame behind the cab region with the spreader and conveyor being through the cab region to mate with the hopper-carried portion of the conveyor. In one embodiment, the bottom of the hopper-carried conveyor portion is flush with the frame which carries the cab-inserted portion of the conveyor, with both portions of the conveyor riding on the truck body frame. Controls and hydraulics for the spreader and the conveyor are conventional, as are the spreaders themselves.

BRIEF DESCRIPTION OF THE DRAWING

These and other features of the subject invention will be better understood in connection with the drawings of which.

DETAILED DESCRIPTION

Figure 1:
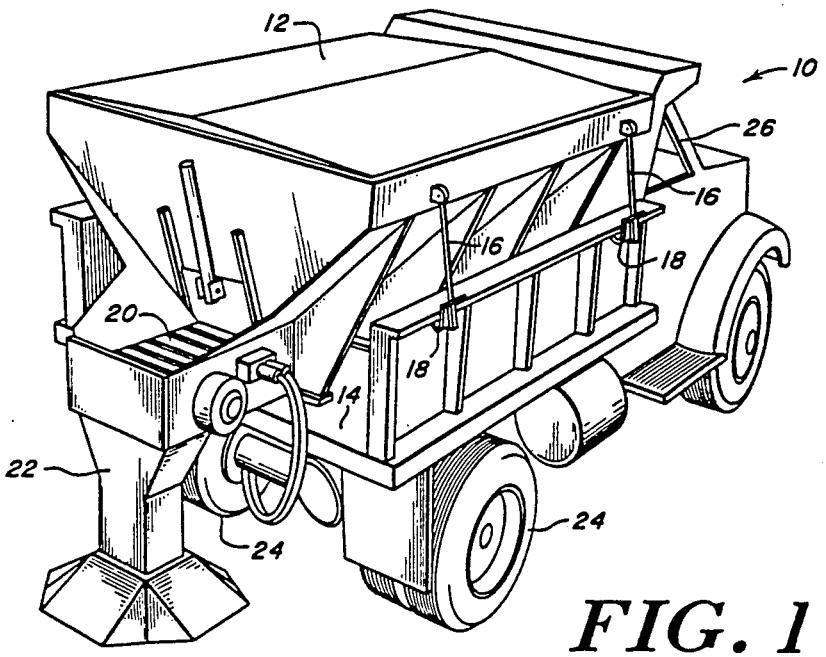
FIG. 1 (PRIOR ART)
FIG. 1 is a diagrammatic illustration of a prior art dump truck fitted with a hopper having a rear spreader.

As illustrated in FIG. 1, a conventional dump truck 10 is provided with a removable hopper 12 which is strapped to the floor 14 of the dump truck by straps 16 and suitable clamping or bolting apparatus 18. Hopper 12 is provided with an integrally mounted conveyor 20 which projects rearwardly from the hopper and to which is mounted rear spreading apparatus 22, which is conventional.

While this type of apparatus readily converts a dump truck to a material spreader, it will be appreciated that the material is dispensed behind rear wheels 24 of truck 10, thereby providing little if any traction for the vehicle. Moreover, the hopper is interposed between the cab 26 and spreader 22, thereby blocking the view of the driver with respect to the amount of material dispensed as well as its direction. Not only is this a significant disadvantage with respect to modified dump trucks, but also should the dump truck need to negotiate a slippery hill, the dump truck must be turned around and backed up the hill so that the material dispensed will be ahead of the rear wheels as the truck is backing up. This is a time-consuming and dangerous method of negotiating slippery hills, and it is a problem endemic with all of the above modified dump trucks.

Figure 2:
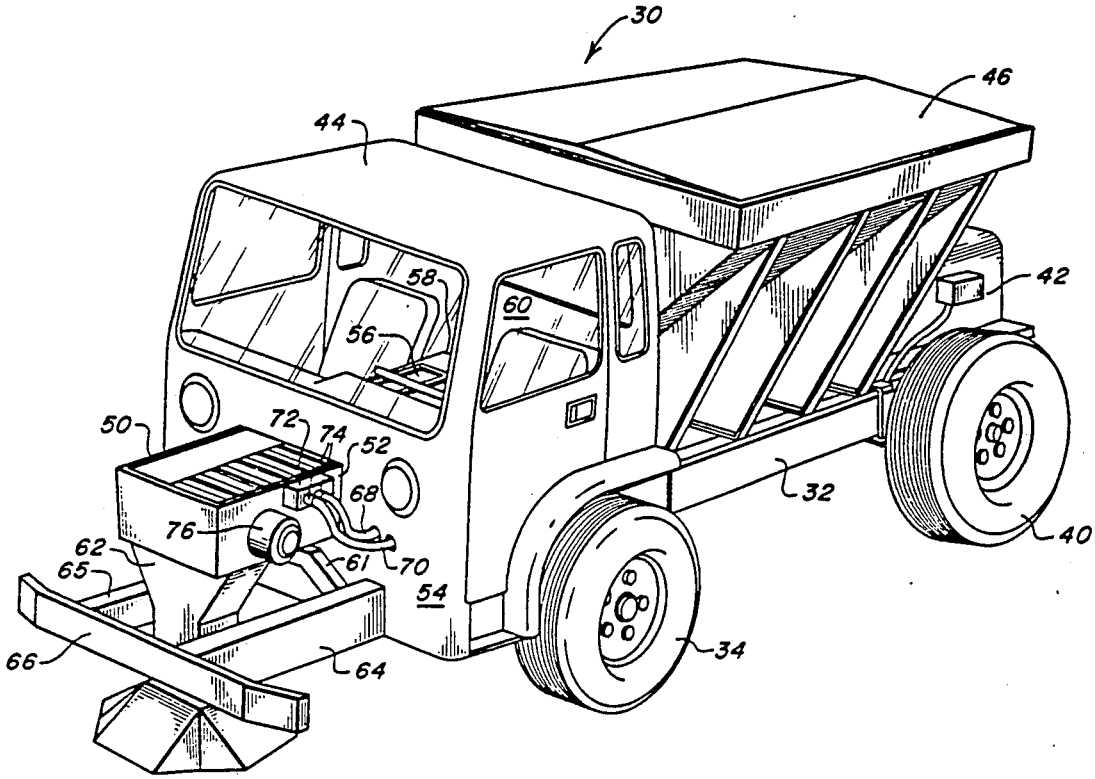
FIG. 2 is a diagrammatic illustration of a vehicle having in combination a rear-mounted engine, a front-mounted cab, a removable hopper therebetween, and a conveyor which runs from the hopper through the center of the cab and projects forwardly of the cab to a forward-mounted spreader.

Referring to FIG. 2, a vehicle 30 which is adapted to dispense materials such as sand, salt, and the like, is provided with a vehicle body 32 having front wheels 34 and rear wheels 40. An engine 42 is mounted above rear wheels 40 at the rear of frame 32. A vehicle cab 44 is mounted to frame 32 over front wheels 34 in a forwardly positioned cab region which extends laterally across vehicle body 32. A removable hopper 46 is clamped to frame 32 between the cab and the motor in any suitable manner.

Figure 3:
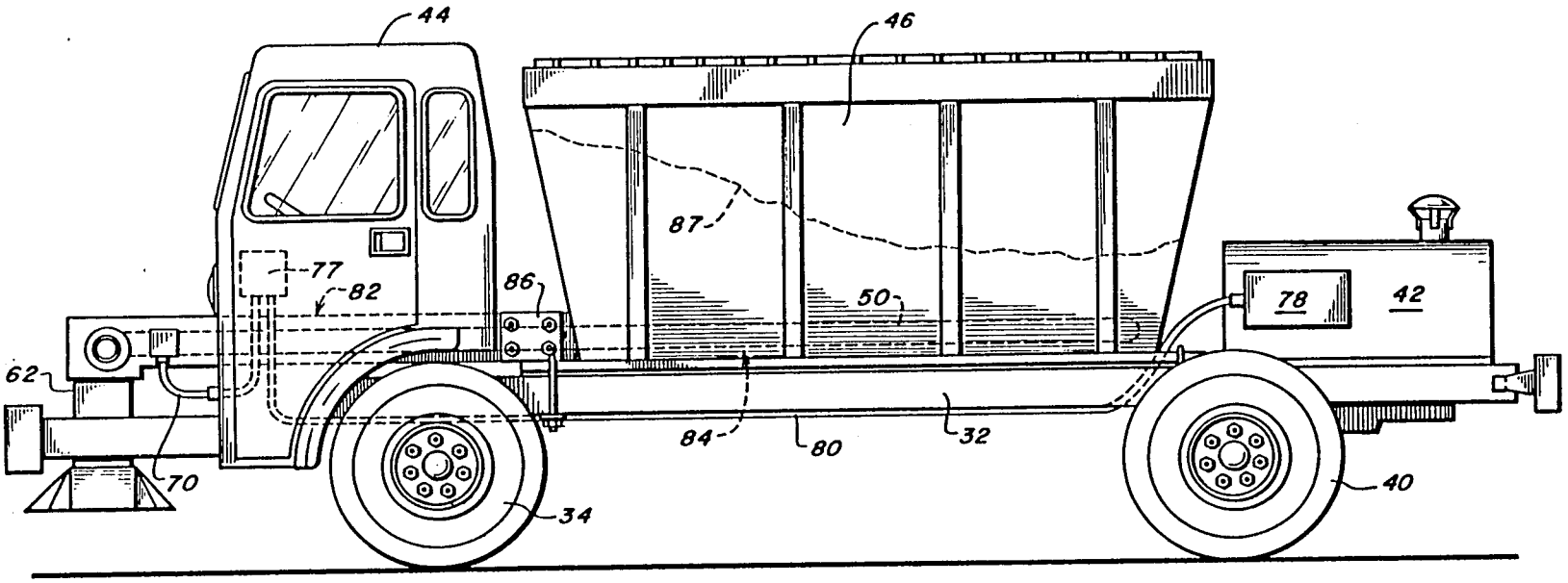
FIG. 3 is a side view of the vehicle of FIG. 2 illustrating the passage of the conveyor from the hopper through the cab to the front-mounted spreader.

A conveyor 50 passes through a port or cutout 52 in the front face 54 of cab 44 and passes through the cab at its center, as illustrated at 56, where it exits a port or cutout 58 at the rear of the cab, with cutout 58 being through rear wall 60. As illustrated in FIG. 3, conveyor 50 is positioned at the base of hopper 46, and in the preferred embodiment, runs the whole length of the trough-shaped bottom of the hopper. Referring back to FIG. 2, the forward end of the conveyor is positioned ahead of the cab, with the front portion of the conveyor being supported by and bolted to strut 61. A conventional spreader 62 is attached to the front portion of the conveyor. The spreader in a preferred embodiment depends between extensions 64 and 65 of frame 32 to permit the positioning of a bumper 66 or snow plough (not shown) ahead of the spreader 62.

The spreader and conveyor in one embodiment are powered hydraulically by hydraulic lines 68 and 70 coupled to the spreader at a junction box 72 which may be provided with quick disconnect couplings 74. A hydraulic motor 76, which may include a reduction gear box (not shown), drives the spreader and conveyor by hydraulic fluid transmitted through lines 68 and 70. Referring again to FIG. 3, hydraulic line 70 is connected to a control valve or sander valve 77 within cab 44. Hydraulic fluid under pressure is provided by a pump 78 driven by engine 42, which is transmitted via line 80 from the rear of the vehicle to the vehicle cab. The spreader and conveyor may alternatively be powered electrically with electric motors, by air pressure, or by direct drive from the vehicle motor.

As illustrated, conveyor 50 may be provided in two segments or sections 82 and 84, with the two sections being joined by apparatus at 86 after hopper 46 is lowered and secured to frame 32.

The removable nature of the hopper and its hopper-carried conveyor section permits adaptation of the use of this vehicle to other purposes when the vehicle is not used for material dispensing or spreading.

As illustrated in FIG. 3, conveyor section 84 runs the entire length of the bottom of the hopper, such that material as illustrated by dotted line 87 is removed first from the rear of the hopper and thence from the forward portion of the hopper, thereby to maintain weight over front wheels 34. Engine 42 maintains sufficient weight over rear wheels 40, with the combined system providing the appropriate traction necessary for operation of the vehicle.

Figure 4:
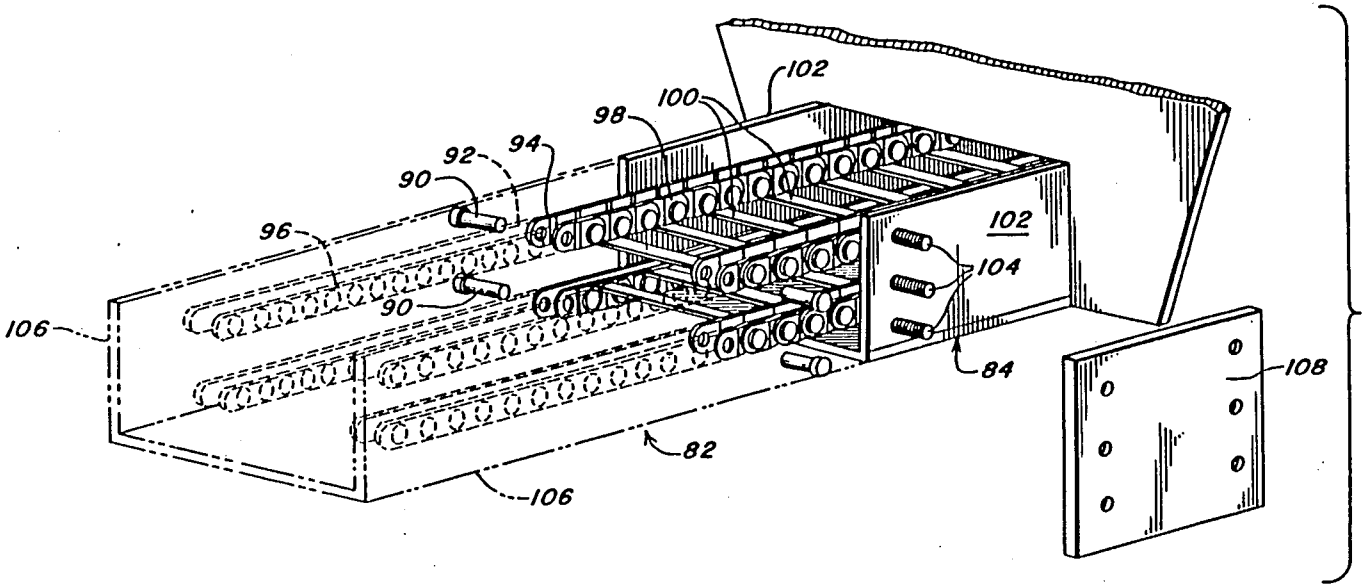
FIG. 4 is a diagrammatic illustration of the connection of the conveyor section carried by the hopper to the conveyor section passing through the cab of the vehicle of FIG. 2.
Figure 5:
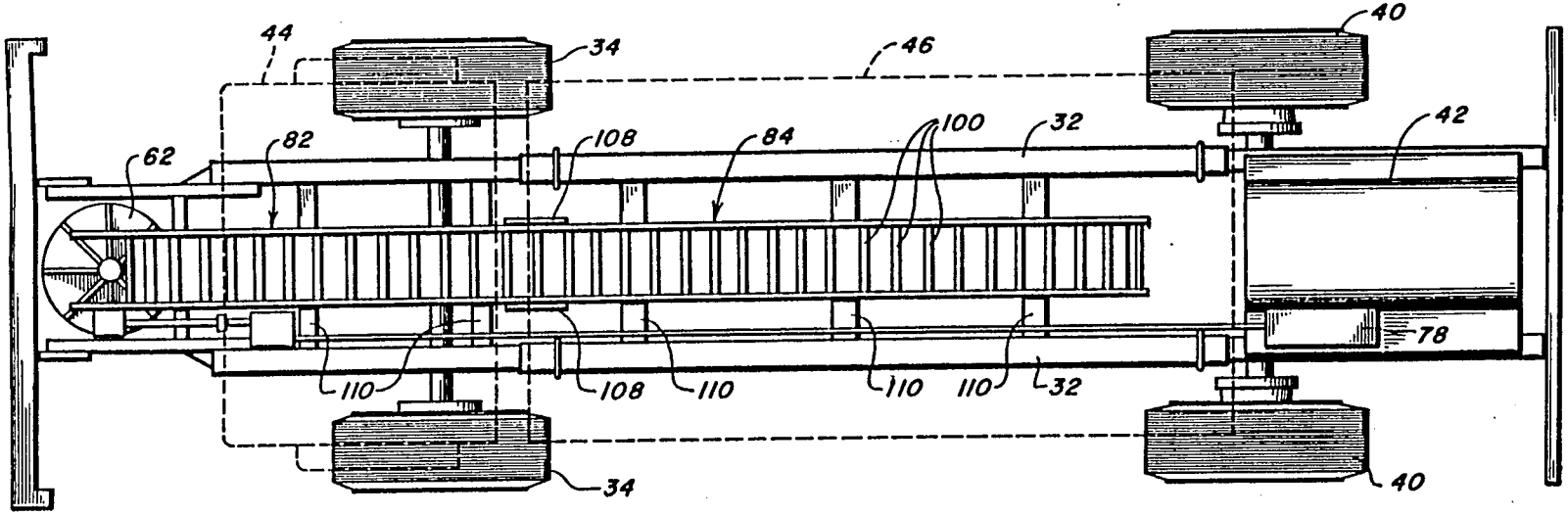
FIG. 5 is a top view of the conveyor utilized in the vehicle of FIG. 2 illustrating the position of the conveyor underneath the hopper and its passage through the cab to the front-mounted spreader.

Referring to FIG. 4, in one embodiment, the two conveyor sections 82 and 84 are joined through the utilization of clevis pins 90 which are passed through appropriate links 92 and 94 for the drive chains 96 and 98 of the respective conveyors. These conveyors are conventionally provided with horizontally running paddles or bars 100 which are driven by the respective chains. The conveyor section carried by the hopper is provided with housing side walls 102 which are provided with outwardly projecting bolts 104, with a similar housing having side walls indicated by dotted lines 106 likewise being provided for section 82 with corresponding outwardly projecting bolts (not shown). A coupling plate 108 is fastened over the side walls of the abutting conveyor sections to complete the attachment of the two conveyor sections. This may be more readily seen with respect to FIG. 5, in which the plates 108 are shown to connect conveyor sections 82 and 84.

If desired, vehicle frame 32 is provided with cross-members 110 on which the conveyor sections rest. It will be appreciated that these cross-members are positoned such that when the hopper rests on frame 32, the conveyor at the bottom thereof rests on the corresponding cross-members. Likewise the cross-members within cab 44 are positioned such that when section 82 is passed through the cab body, it is in alignment with the mating section 84, which extends from the forward portion of hopper 46.

In order to adapt the vehicle for spreading operation, the hopper is first lowered onto frame 32 and the conveyor with the spreader attached is slidably mounted through a channel in the cab region until the opposed conveyor sections mate. This provides an exceedingly simple method of adapting the vehicle to a spreading use.

Figure 6:
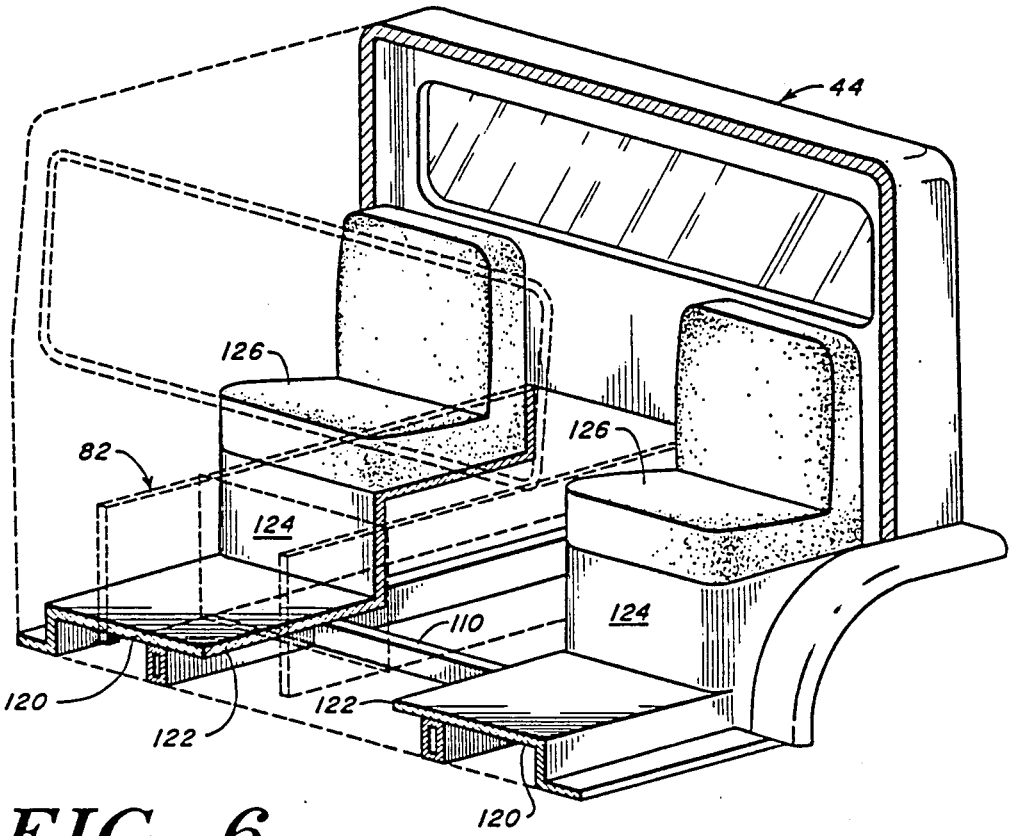
FIG. 6 is a diagrammatic illustration of a portion of the cab illustrating the channelling of the cab floor and seat supports to permit passage of the conveyor therethrough.

Referring now to FIG. 6, a portion of cab 44 is illustrated to indicate that the floor 120 of the cab is channeled at 122 to provide for the insertion of conveyor section 82 such that the bottom of this conveyor section rests on the cross-members. Likewise supports 124 for seats 126 are cut out so as to permit passage of the conveyor through the center of the cab.

Figure 7:
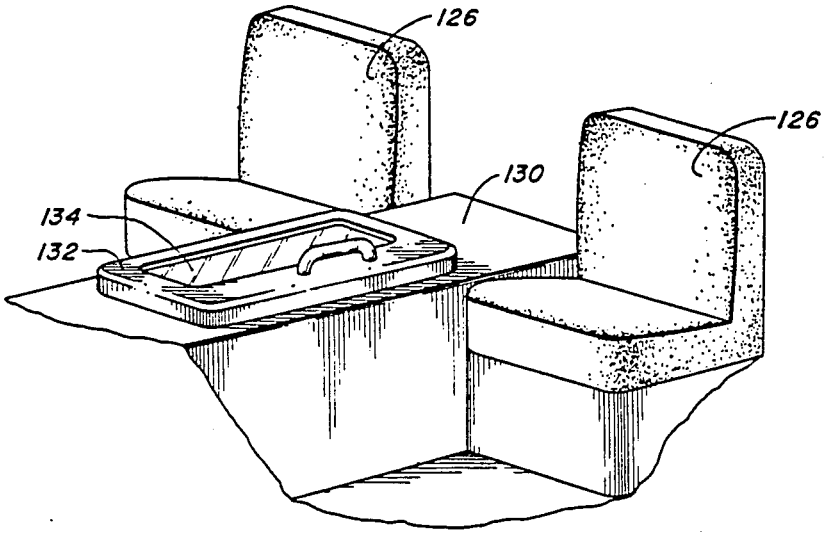
FIG. 7 is a diagrammatic illustration of the covered portion of the conveyor which passes through the cab illustrating a viewing port and a hatch for access to the conveyor from within the cab.

In one embodiment, the conveyor apparatus may be open to the cab, or in an another embodiment as illustrated in FIG. 7, a housing 130 may be provided to cover the conveyor passing through the cab, with a hatch 132 being provided to permit access from the cab to the conveyor from within the cab itself. This hatch in one embodiment is provided with a viewing port 134 which permits viewing of the dispensed material as it is being transported to the spreader.

It will be appreciated that cutouts 52 and 58 may be provided with suitable covers when the conveyor section does not pass through the cab body, thereby permitting use of the vehicle for other than a spreading use.

Figure 8:
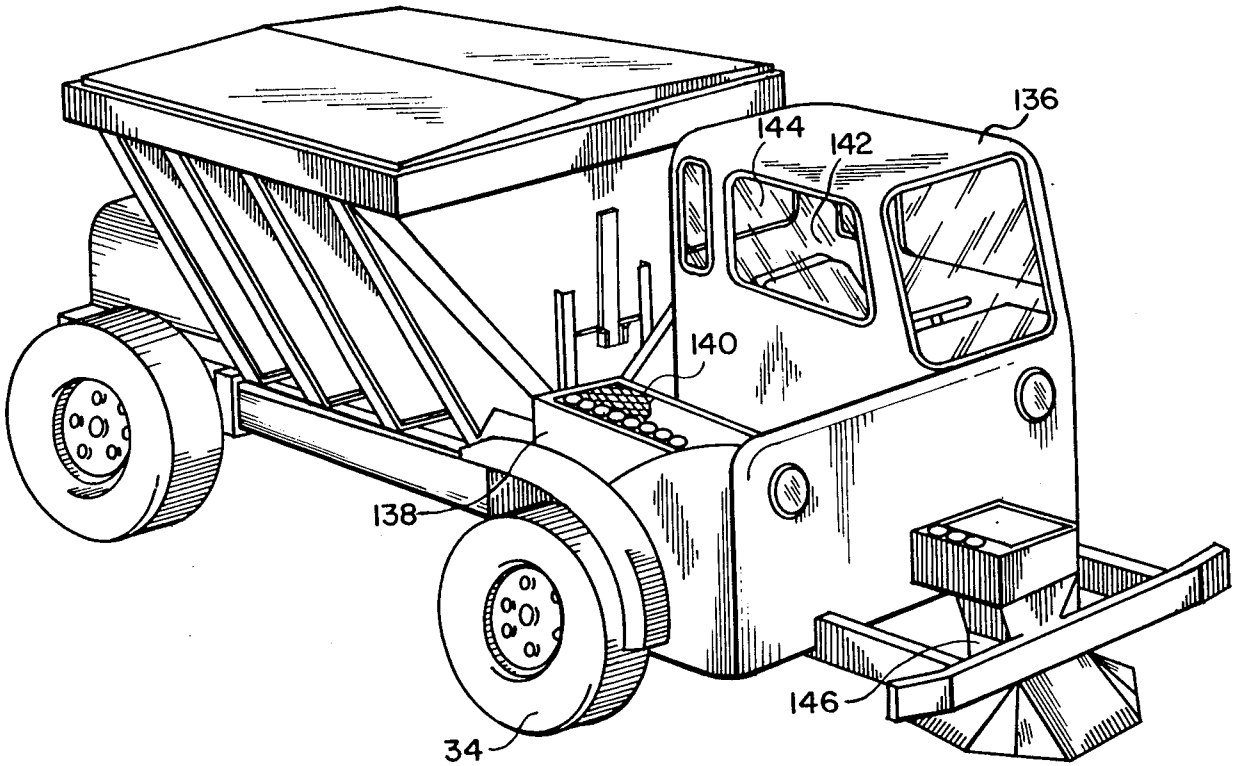
FIG. 8 is a diagrammatic illustration of a vehicle having in combination a rear-mounted engine, a front-mounted half-cab, a removable hopper therebetween, and a conveyor with an expanded metal screen which runs from the hopper through the cab region and projects forwardly of the cab to a forward-mounted spreader.

In another embodiment of the invention illustrated in FIG. 8, the cab 44 is replaced by a half-cab 136, occupying only the left most portion of the cab region at the forward end of the vehicle. In this case the conveyor system comprises a centrally disposed conveyor system 138 running substantially along the center line of the vehicle and beside the cab portion 136. Typically a screen such as an expanded metal screen 140 will cover the entire length of the conveyor system to prevent the entry of sizable objects onto the belt of the conveyor system 138. Access may be provided as desired to the conveyor system 138 for purposes of clearing jams or otherwise. A window 144 provides operator monitoring of the sand and salt mixture as it travels down the belt of the conveyor system 138 toward the spreader portion 146.

The embodiment of FIG. 8 is substantially the same as the previously described embodiment with respect to the front operating and centrally disposed spreader and conveyor systems, respectfully, but accomodates a partial or half-cab conversion of the vehicle itself.

Figure 9:
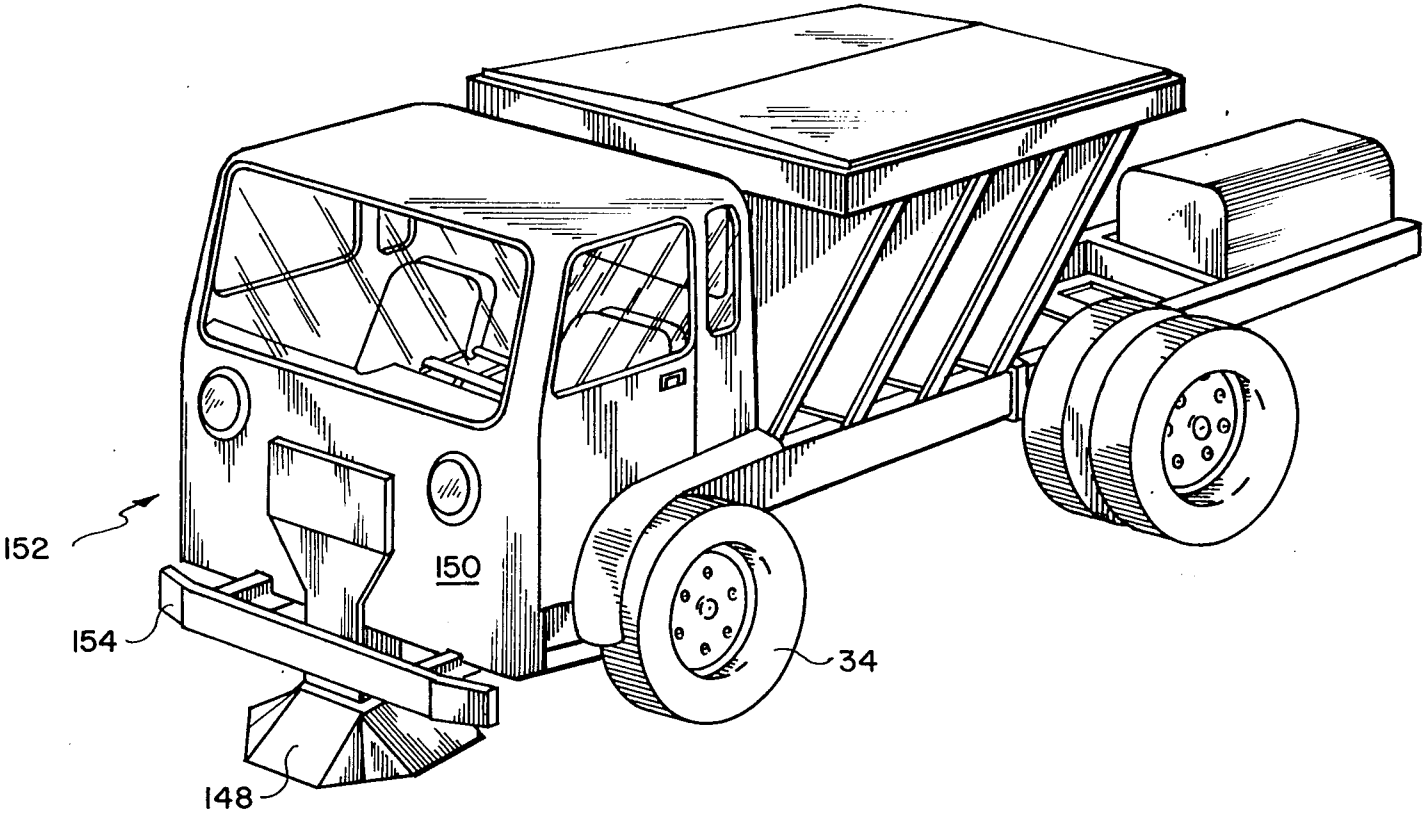
FIG. 9 is a diagrammatic illustration of a vehicle having in combination a rear-mounted engine, a front-mounted cab, a removable hopper therebetween, and a conveyor which runs through the center of the cab to a forward-mounted spreader which is recessed below the cab.
Figure 10:
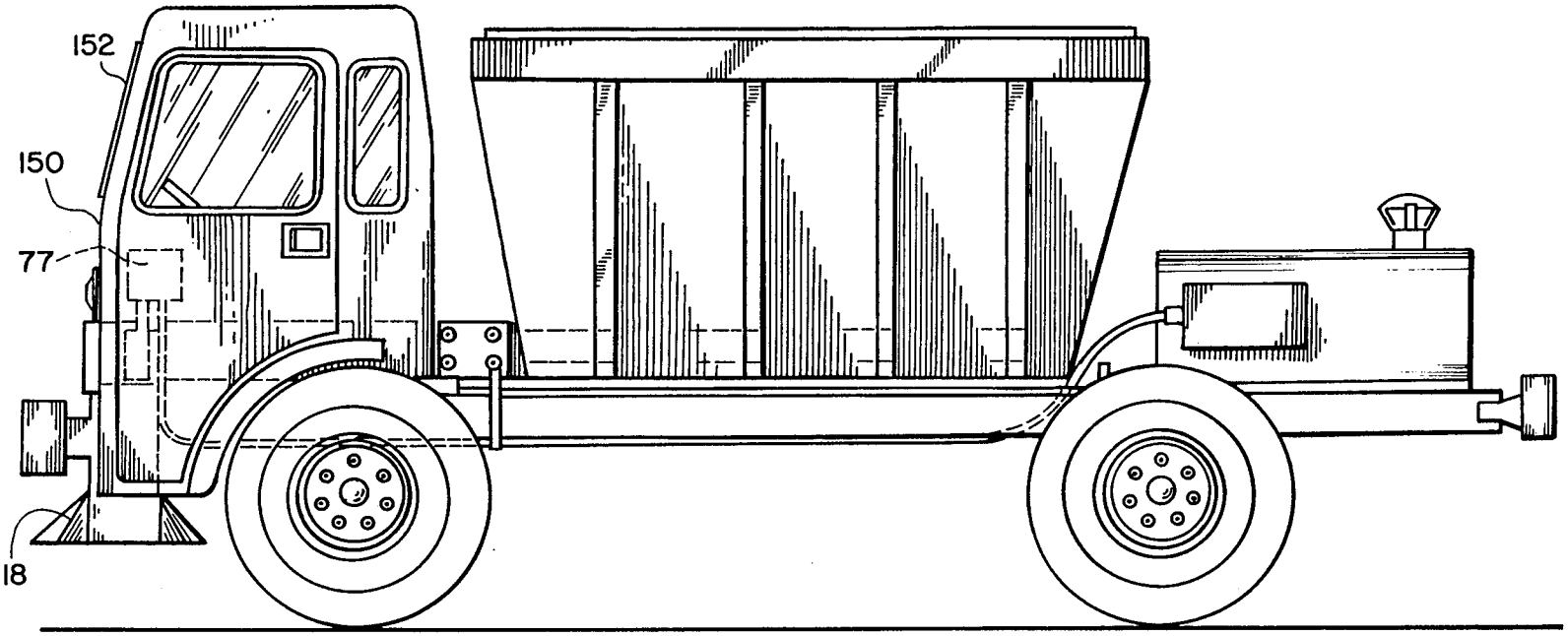
FIG. 10 is a side view of the vehicle in FIG. 9 illustrating the passage of the conveyor through the cab to the recessed, front-mounted spreader.

In another embodiment illustrated in FIGS. 9 and 10 a spreader mechanism 148 is recessed at least partially and possibly entirely behind a front face 150 of the cab 152. This permits a bumper 154 to be located in a substantially normal position with respect to the cab 152, less than one foot from front face 150, and hides the spreader mechanism and end of the conveyor portion from view providing a more aesthetically pleasing vehicle front portion.

The modification represented by FIGS. 9 and 10 can be additionally applied to the vehicle of FIG. 8 as desired.

The spreader mechanism 148 is still located ahead of the front wheels 34 to insure the application of the sand and/or salt mixture on the road surface ahead of the front wheels thereby insuring they will receive full traction.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. An adaptable material spreading vehicle comprising:

a vehicle body having a frame and front and rear wheels;

an engine mounted to said frame operably connected to said wheels;

an operator cab mounted to said frame at a forwardly positioned cab region centrally disposed between the wheels;

a removable hopper mounted to said frame rearward of said cab region;

a conveyor positioned in a channel passing through said cab region and extending from beneath said hopper to the forward end of said vehicle body, and wherein said channel passes through said cab region to permit visual inspection of dispensed material carried by said conveyor from said operator cab; and a spreader attached to the end of said conveyor mounted to the forward end of said vehicle body and means for driving said conveyor and spreader.

2. The vehicle according to claim 1 wherein said engine is mounted over the rear wheels of said vehicle body.

3. The vehicle according to claim 1, wherein said spreader is mounted ahead of said cab such that said spreader is visible from said cab.

4. The vehicle according to claim 1 wherein said cab has a front face positioned forward of an operator position within the cab;

at least part of said spreader being mounted substantially rearward of said front face such that at least some of said spreader is mounted within said cab region.

5. The vehicle according to claim 4 further including a bumper mounted directly forward of said front face.

6. The vehicle according to claim 1 wherein said conveyor includes two mateable sections, one carried by the hopper with a portion thereof extending forwardly of said hopper, the other section being positioned through said cab region to abut said one section, and means for coupling said sections together.

7. The vehicle according to claim 1 wherein said cab region has a longitudinally extending channel therethrough for said conveyor with front and back walls each having a port adjacent an end of said channel.

8. The vehicle according to claim 7 wherein said conveyor is at least partially exposed in said cab.

9. The vehicle according to claim 7 wherein said cab includes a cover over at least a portion of said channel and said conveyor whereby said conveyor is at least partially covered with said cab.

10. The vehicle according to claim 9 wherein said cover includes a trap door.

11. The vehicle according to claim 9 wherein at least a portion of said cover is optically transparent.

12. The vehicle according to claim 1 wherein said drive means includes a hydraulic motor mounted to said conveyor, and further including a hydraulic pump driven by said engine, the output of said pump having means for operably coupling hydraulic fluid to said hydraulic motor.

13. The vehicle according to claim 12 wherein said cab includes hydraulic fluid control means and wherein said hydraulic fluid coupling means includes hydraulic fluid lines from said pump to said control means and from said control means to said hydraulic motor.

14. The vehicle according to claim 13 and further including quick disconnect couplings between said control means and said hydraulic motor.

15. The vehicle according to claim 1 and further including members extending forward of said cab and surrounding and projecting in front of said spreader, said members adapted to receive additional apparatus at the forward ends thereof.

16. The vehicle according to claim 1 wherein said conveyor extends the entire bottom length of said hopper, thereby to initially remove hopper-carried material from the back portion of said hopper during conveyor operation.

17. The vehicle according to claim 1 wherein said cab occupies only a portion of said cab region to one side of said conveyor.

18. An adaptable material spreading vehicle, comprising:

a vehicle body having a frame and front and rear wheels;

an engine mounted to said frame operably connected to said wheels;

an operator cab mounted to said frame at a forwardly positioned cab region centrally disposed between the wheels, said cab region having a longitudinally extending channel therethrough and front and back walls each having a port adjacent an end of said channel;

a removable hopper mounted rearward of said cab region;

a conveyor positioned in said channel passing through said cab region and extending from beneath said hopper to the forward end of said vehicle body and wherein said conveyor is least partially exposed in said cab; and a spreader attached to the end of said conveyor mounted to the forward end of said vehicle body and means for driving said conveyor and spreader.

* * * * *

UNITED STATES PATENT AND TRADEMARK OFFICE

CERTIFICATE OF CORRECTION

PATENT NO. : 4,767,063

DATED : August 30, 1988

INVENTOR(S) : Albert J. Wall; James T. Wall

It is certified that error appears in the above-identified patent and that said Letters Patent is hereby corrected as shown below:

In the Abstract

15th line, "cab-carrier" should read --cab-carried--
17th line, "hopper through" should read --hopper trough--

Column 5, lines 30-31, "posi- toned" should read --posi- tioned--
line 53, "in an another" should read --in another--

Column 6, line 7, "desired to" should read --desired from the operator location 142 to--
line 9, "144 provides" should read --144, in conjunction with another window or viewing port above the conveyor, provides--
line 16, "respectfully, but accomodates" should read --respectively, but accommodates--

Column 8, line 36, "is least" should read --is at least--

Signed and Sealed this

Twenty-ninth Day of August, 1989

*Attest:*

*Attesting Officer*

DONALD J. QUIGG

*Commissioner of Patents and Trademarks*